US011105348B2

(12) United States Patent
Kim et al.

(10) Patent No.: US 11,105,348 B2
(45) Date of Patent: Aug. 31, 2021

(54) SYSTEM FOR CONTROLLING CONSTRUCTION MACHINERY AND METHOD FOR CONTROLLING CONSTRUCTION MACHINERY

(71) Applicant: DOOSAN INFRACORE CO., LTD., Incheon (KR)

(72) Inventors: Chang-mook Kim, Seongnam-si (KR); Woo-yong Jung, Seoul (KR); Hyeon-sik Ahn, Seoul (KR); Ki-yong Kim, Seoul (KR)

(73) Assignee: DOOSAN INFRACORE CO., LTD., Incheon (KR)

( * ) Notice: Subject to any disclaimer, the term of this patent is extended or adjusted under 35 U.S.C. 154(b) by 0 days.

(21) Appl. No.: 16/332,698

(22) PCT Filed: Sep. 12, 2017

(86) PCT No.: PCT/KR2017/010012

§ 371 (c)(1),
(2) Date: Mar. 12, 2019

(87) PCT Pub. No.: WO2018/048291

PCT Pub. Date: Mar. 15, 2018

(65) Prior Publication Data

US 2019/0218751 A1 Jul. 18, 2019

(30) Foreign Application Priority Data

Sep. 12, 2016 (KR) ..... 10-2016-0117496

(51) Int. Cl.
*F15B 11/17* (2006.01)

(52) U.S. Cl.
CPC ..... *F15B 11/17* (2013.01); *F15B 2211/6658* (2013.01)

(58) Field of Classification Search
CPC ..... F15B 11/17; F15B 2211/6355; F15B 2211/6658
See application file for complete search history.

(56) References Cited

U.S. PATENT DOCUMENTS 5,490,384 A * 2/1996 Lunzman ..... E02F 9/2221 60/327
5,784,883 A * 7/1998 Ohkura ..... B60W 10/06 60/327

(Continued)

FOREIGN PATENT DOCUMENTS

EP 2985391 A1 2/2016
JP 05-017202 U 3/1993

(Continued)

OTHER PUBLICATIONS

International Search Report for PCT/KR2017/010012 dated Dec. 12, 2017.

(Continued)

*Primary Examiner* — F Daniel Lopez
(74) *Attorney, Agent, or Firm* — Hauptman Ham, LLP

(57) ABSTRACT

A control system for construction machinery, includes a hydraulic pump, first and second actuators connected to the hydraulic pump through first and second parallel lines respectively, first and second control valves installed in the first and second parallel lines respectively and configured to control operations of the first and second actuators, first and second spool displacement adjusting valves configured to control displacement amounts of the spools of the first and second control valves, and a control valve control portion configured to output the control signal, and configured to limit a maximum allowable value of the manipulation signal for the first actuator to a value selected by the operator and limit a spool displacement amount of the second control valve according to the limited manipulation signal for the (Continued)

first actuator when the manipulation signal for a multiple operation of the first and second actuators is received.

8 Claims, 8 Drawing Sheets

(56) References Cited

U.S. PATENT DOCUMENTS

| | | | | |
|---|---|---|---|---|
| 6,050,090 | A | 4/2000 | Tohji | |
| 6,561,076 | B2 * | 5/2003 | Hou | A01B 63/00 60/386 |
| 6,823,672 | B2 * | 11/2004 | Nakamura | E02F 9/2235 60/449 |
| 2015/0361995 | A1 | 12/2015 | Joung et al. | |

FOREIGN PATENT DOCUMENTS

| | | | |
|---|---|---|---|
| JP | 10-072850 | A | 3/1998 |
| JP | 5946594 | B2 | 7/2016 |
| KR | 10-2014-0034833 | A | 3/2014 |
| KR | 10-2016-0091964 | A | 8/2016 |

OTHER PUBLICATIONS

Extended European Search Report dated Mar. 25, 2020, in connection with the European Patent Application No. 17849175.9.

* cited by examiner

SYSTEM FOR CONTROLLING CONSTRUCTION MACHINERY AND METHOD FOR CONTROLLING CONSTRUCTION MACHINERY

CROSS REFERENCE TO RELATED APPLICATION

This present application is a national stage filing under 35 U.S.C § 371 of PCT application number PCT/KR2017/010012 filed on Sep. 12, 2017 which is based upon and claims the benefit of priority to Korean Patent Application No. 10-2016-0117496 filed on Sep. 12, 2016 in the Korean Intellectual Property Office. The disclosures of the above-listed applications are hereby incorporated by reference herein in their entirety.

TECHNICAL FIELD

The present invention relates to a control system for construction machinery and a control method for construction machinery. More particularly, the present invention relates to a control system for construction machinery including an electro-hydraulic main control valve using an electro proportional pressure reducing valve and a control method for construction machinery using the same.

BACKGROUND ART

Recently, in construction machinery, an electro-hydraulic main control valve with an electro proportional pressure reducing valve (EPPRV) may be used. When a multiple operation of actuators which are driven by at least two hydraulic pumps is performed, a power of an engine may be distributed to the hydraulic pumps according to a constant horsepower distribution ratio.

In construction machinery including a hydraulic main control valve, an orifice structure may be installed in a hydraulic line to adjust balance in flow distribution between actuators in a multiple operation.

However, inefficient flow distribution and deterioration in controllability may occur due to a fixed orifice area in the orifice structure, and when a relatively great load is exerted on the actuator, fuel efficiency may be decreased due to pressure loss. Especially, during the horsepower distribution control of the hydraulic pumps, a balance in flow distribution may be further required for work efficiency.

DISCLOSURE OF THE INVENTION

Problems to be Solved

An object of the present invention provides a control system for construction machinery capable of enhancing fuel efficiency and improving controllability and work efficiency.

Another object of the present invention provides a control method for construction machinery using the above control system.

Means to Solve the Problems

According to example embodiments, a control system for construction machinery, includes a first hydraulic pump, first and second actuators connected to the first hydraulic pump through first and second parallel lines respectively and operable by a working oil discharged from the first hydraulic pump, first and second control valves installed in the first and second parallel lines respectively and configured to control operations of the first and second actuators, first and second spool displacement adjusting valves configured to supply a pilot signal pressure to spools of the first and second control valves in proportion to an inputted control signal to control displacement amounts of the spools of the first and second control valves, and a control valve control portion configured to output the control signal to the first and second spool displacement adjusting valves corresponding to a manipulation signal of an operator, and configured to limit a maximum allowable value of the manipulation signal for the first actuator to a value selected by the operator and limit a spool displacement amount of the second control valve according to the limited manipulation signal for the first actuator when the manipulation signal for a multiple operation of the first and second actuators is received.

In example embodiments, the control valve control portion may convert a size of the manipulation signal for the first actuator at a ratio selected by the operator and output, to the second spool displacement adjusting valve, the control signal which is capable of decreasing a conversion ratio of a spool displacement of the second control valve to the manipulation signal for the second actuator in proportion to the size of the converted manipulation signal for the first actuator.

In example embodiments, the first and second spool displacement adjusting valves may include an electro proportional pressure reducing valve (EPPRV).

In example embodiments, the control valve control portion may include a first joystick converter to convert an inputted first joystick displacement amount for the first actuator into a secondary first joystick displacement amount having a value reduced at the limiting ratio selected by the operator, a second joystick converter to convert an inputted second joystick displacement amount for the second actuator into a secondary second joystick displacement amount having a value that is reduced in proportion to the secondary first joystick displacement amount of the first actuator, and an output portion to output the control signal for controlling the pilot signal pressure in proportion to the secondary first and second joystick displacement amounts.

In example embodiments, the control system for construction machinery may further include a secondary hydraulic pump driven by an engine which drives the first hydraulic pump and configured to supply a working oil to the second actuator, and a pump control portion configured to control discharge pressures of the first and second hydraulic pumps according to a horsepower distribution ratio.

In example embodiments, the pump control portion may control a horsepower ratio of the first and second hydraulic pumps according to the horsepower distribution ratio selected by the operator.

In example embodiments, a range of the limiting ratio of the manipulation signal selected by the operator may be determined based on the horsepower distribution ratio.

In example embodiments, the first actuator may include a swing motor and the second actuator may include a boom cylinder, and the first control valve may include a swing control valve and the second control valve may include a boom control valve.

According to example embodiments, in a control method for construction machinery, a hydraulic system including first and second actuators connected to a first hydraulic pump through first and second parallel lines respectively and first and second control valves installed in the first and second parallel lines respectively and configured to control operations of the first and second actuators, is provided. A manipulation signal of an operator for first and second actuators and a limiting ratio of the manipulation for the first actuator selected by an operator are received. A maximum allowable value of the manipulation signal for the first actuator is limited at the limiting ratio when the manipulation signal for a multiple operation of the first and second actuators is received. A spool displacement amount of the second control valve to the manipulation signal for the second actuator is limited according to the limited manipulation signal for the first actuator.

In example embodiments, limiting the maximum allowable value of the manipulation signal for the first actuator at the limiting ratio may include converting a size of the manipulation signal for the first actuator at the limiting ratio selected by the operator, and limiting the spool displacement amount of the second control valve may include decreasing a conversion ratio of the spool displacement of the second control valve to the manipulation signal for the second actuator in proportion to the size of the limited manipulation signal for the first actuator.

In example embodiments, receiving the manipulation signal of the operator for first and second actuators may include receiving joystick displacement amounts for the first and second actuators, limiting the maximum allowable value of the manipulation signal for the first actuator may include converting the inputted first joystick displacement amount for the first actuator into a secondary first joystick displacement amount having a value reduced at the limiting ratio selected by the operator orifice, and limiting the spool displacement amount of the second control valve may include converting the inputted second joystick displacement amount for the second actuator into a secondary second joystick displacement amount having a value that is reduced in proportion to the secondary first joystick displacement amount of the first actuator.

In example embodiments, the control method for construction machinery may further include supplying a pilot signal pressure for controlling the spool displacements of the first and second control valves according to the secondary first joystick displacement amount and the secondary second joystick displacement amount, to spools of the first and second control valves.

In example embodiments, the first and second spool displacement adjusting valves may include an electro proportional pressure reducing valve (EPPRV).

In example embodiments, the control method for construction machinery may further include providing a secondary hydraulic pump driven by an engine which drives the first hydraulic pump and configured to supply a working oil to the second actuator, and controlling discharge pressures of the first and second hydraulic pumps according to a horsepower distribution ratio.

In example embodiments, controlling discharge pressures of the first and second hydraulic pumps may include controlling a horsepower ratio of the first and second hydraulic pumps according to a horsepower distribution ratio selected by the operator.

In example embodiments, a range of the limiting ratio of the manipulation signal selected by the operator is determined based on the horsepower distribution ratio.

Effects of the Invention

According to example embodiments, a horsepower distribution ratio of first and second hydraulic pumps may be controlled according to a pump horsepower distribution ratio selected by an operator, and even when the first and second hydraulic pumps are operated according to the pump horsepower distribution ratio, a spool displacement of a swing control valve may be limited according to a limiting ratio of a swing joystick displacement selected by the operator to control a swing orifice area. Further, a spool displacement of a boom control valve may be limited according to the limited swing joystick displacement to control a boom orifice area.

Accordingly, an orifice area ratio of the hydraulic lines though which a working oil is supplied to the actuators may be controlled by performing the pump power distribution control and the spool displacement control of the control valve using EPPRV, a speed balance between the actuators may be adjusted to match user's situation in a variety of working conditions. Thus, user convenience may be improved and work efficiency may be maximized.

However, the effect of the invention may not be limited thereto, and may be expanded without being deviated from the concept and the scope of the present invention.

BEST MODE FOR CARRYING OUT THE INVENTION

Figure 1:
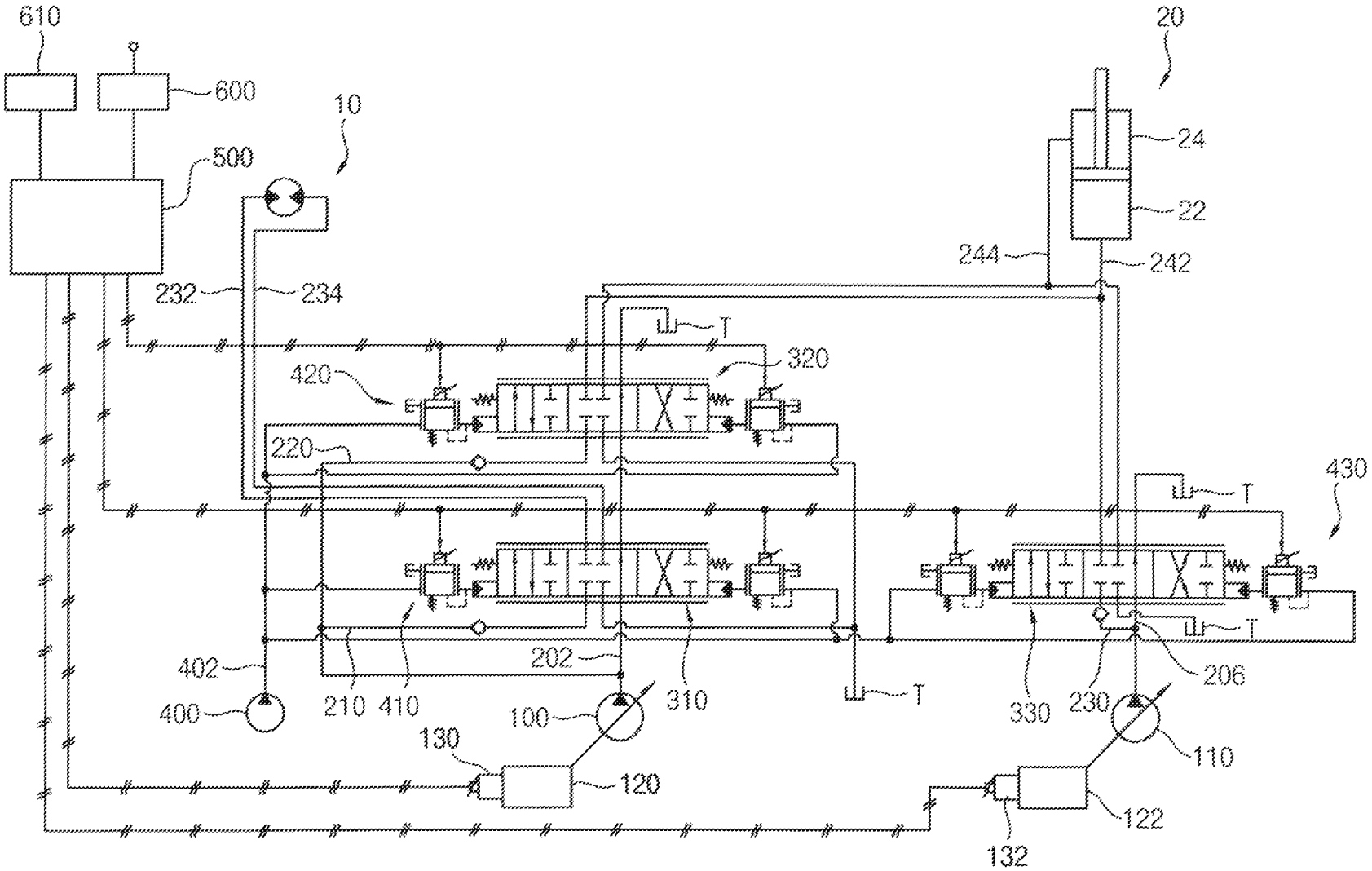
FIG. 1 is a hydraulic circuit diagram illustrating a control system for construction machinery in accordance with example embodiments.

Hereinafter, preferable embodiments of the present invention will be explained in detail with reference to the accompanying drawings.

In the drawings, the sizes and relative sizes of components or elements may be exaggerated for clarity.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of example embodiments.

The terminology used herein is for the purpose of describing particular example embodiments only and is not intended to be limiting of example embodiments. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Example embodiments may, however, be embodied in many different forms and should not be construed as limited to example embodiments set forth herein. Rather, these example embodiments are provided so that this disclosure will be thorough and complete, and will fully convey the scope of example embodiments to those skilled in the art.

Figure 2:
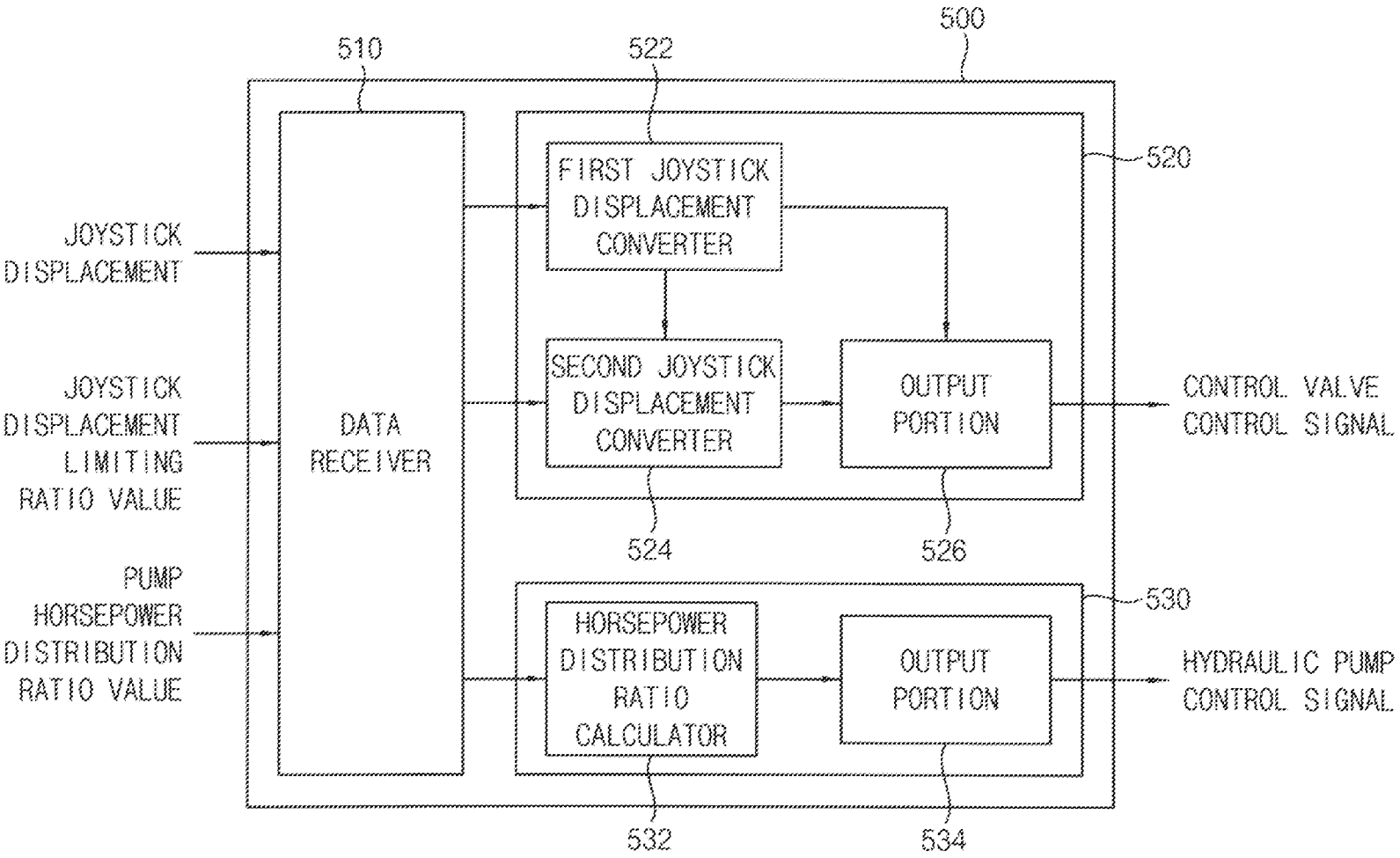
FIG. 2 is a block diagram illustrating a controller of the control system in FIG. 1.
Figure 3:
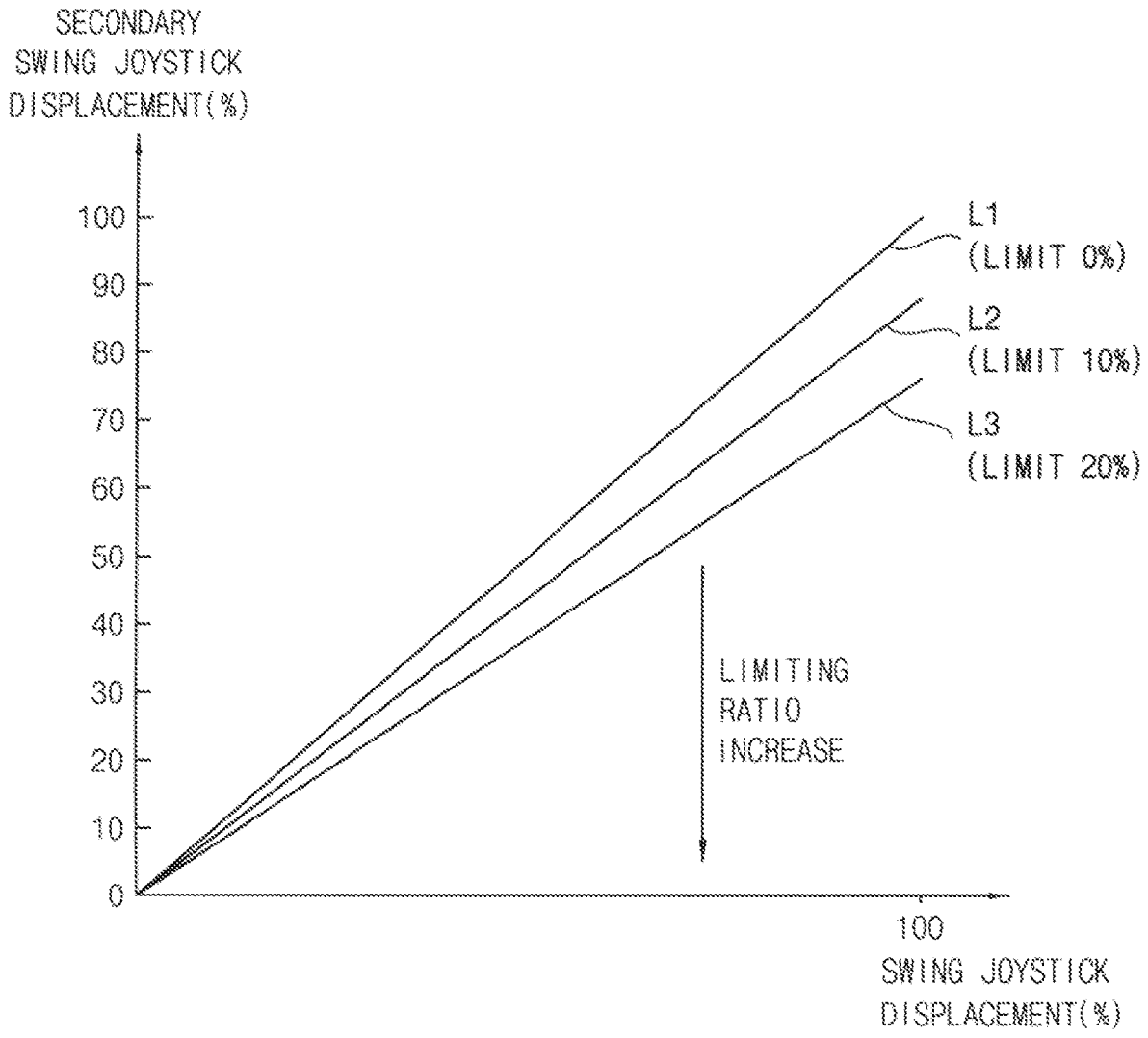
FIG. 3 is a graph illustrating a swing joystick displacement limit map according to a limiting ratio selected by an operator, which is stored in the controller in FIG. 2.
Figure 4:
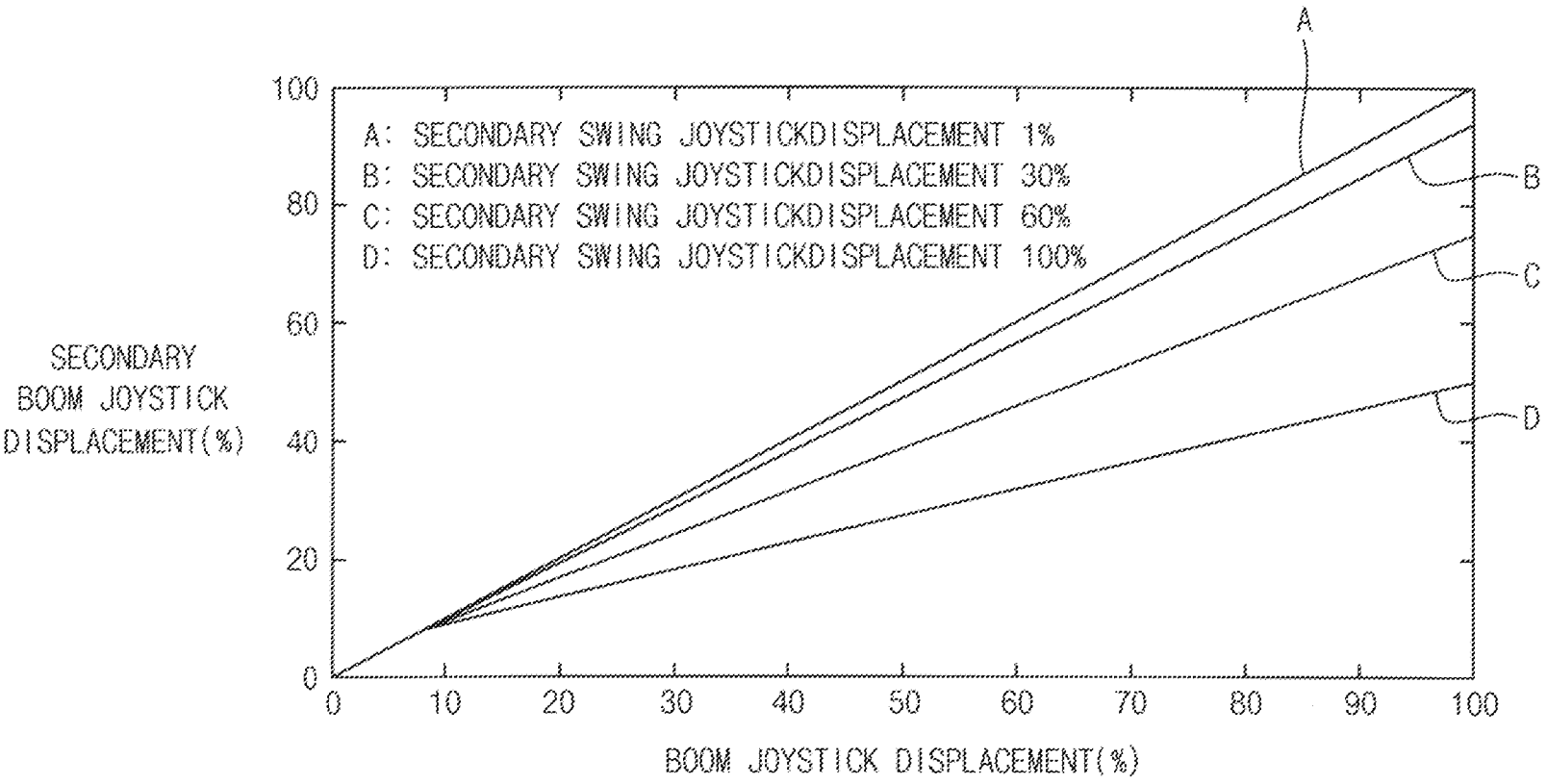
FIG. 4 is a graph illustrating a boom joystick displacement limit map according to a secondary swing joystick displacement in FIG. 3.
Figure 5:
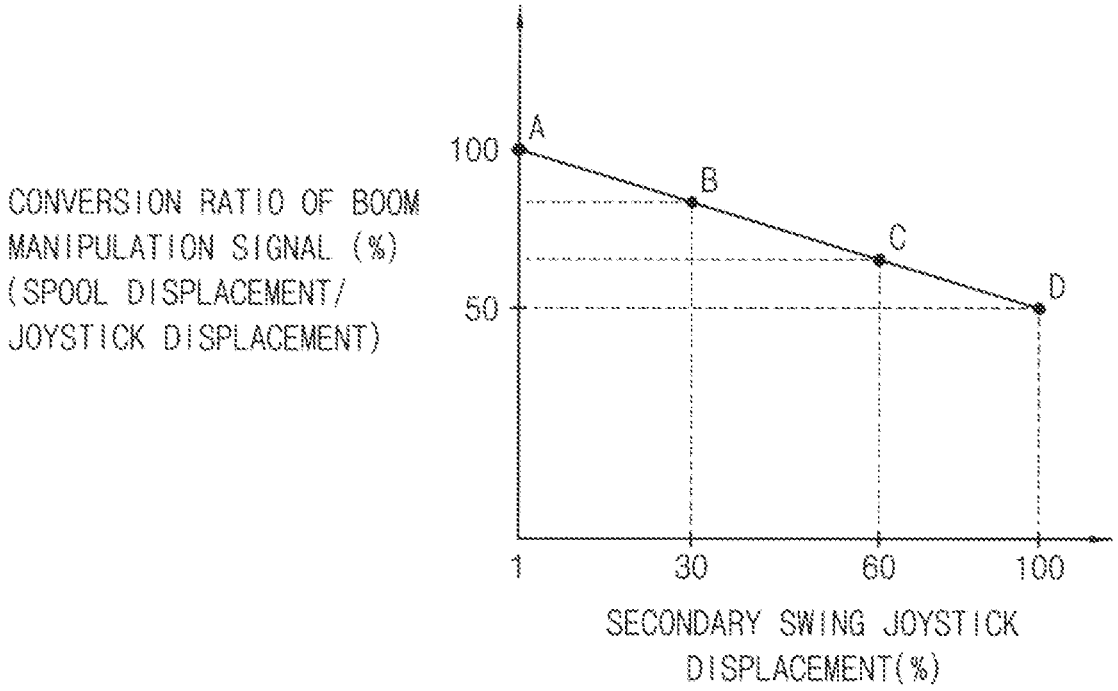
FIG. 5 is a graph illustrating a conversion ratio of a boom joystick displacement according to the boom joystick displacement limit map in FIG. 4.
Figure 6:
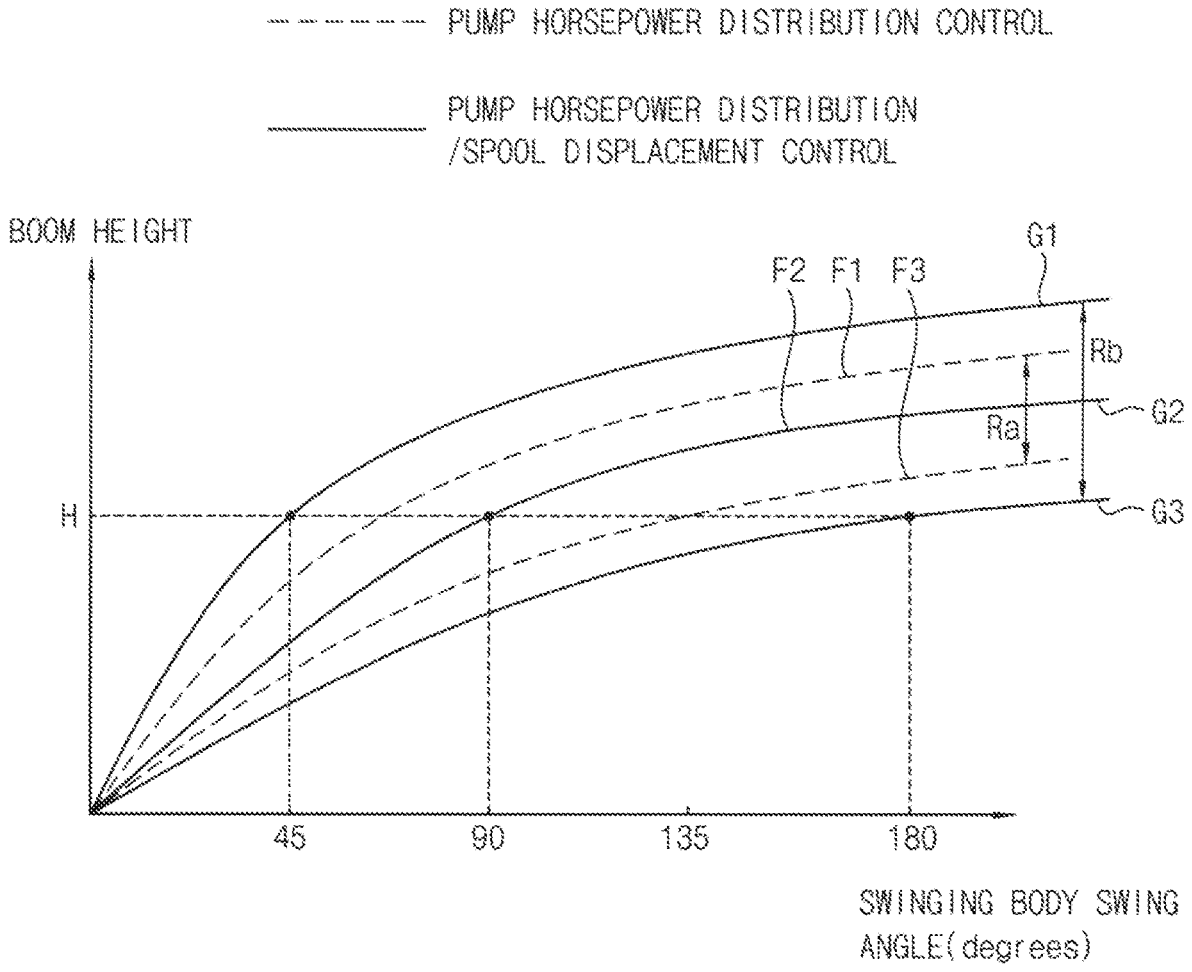
FIG. 6 is a graph illustrating a boom height to a swing angle in a pump horsepower distribution control and a pump horsepower distribution/spool displacement control.
Figure 7:
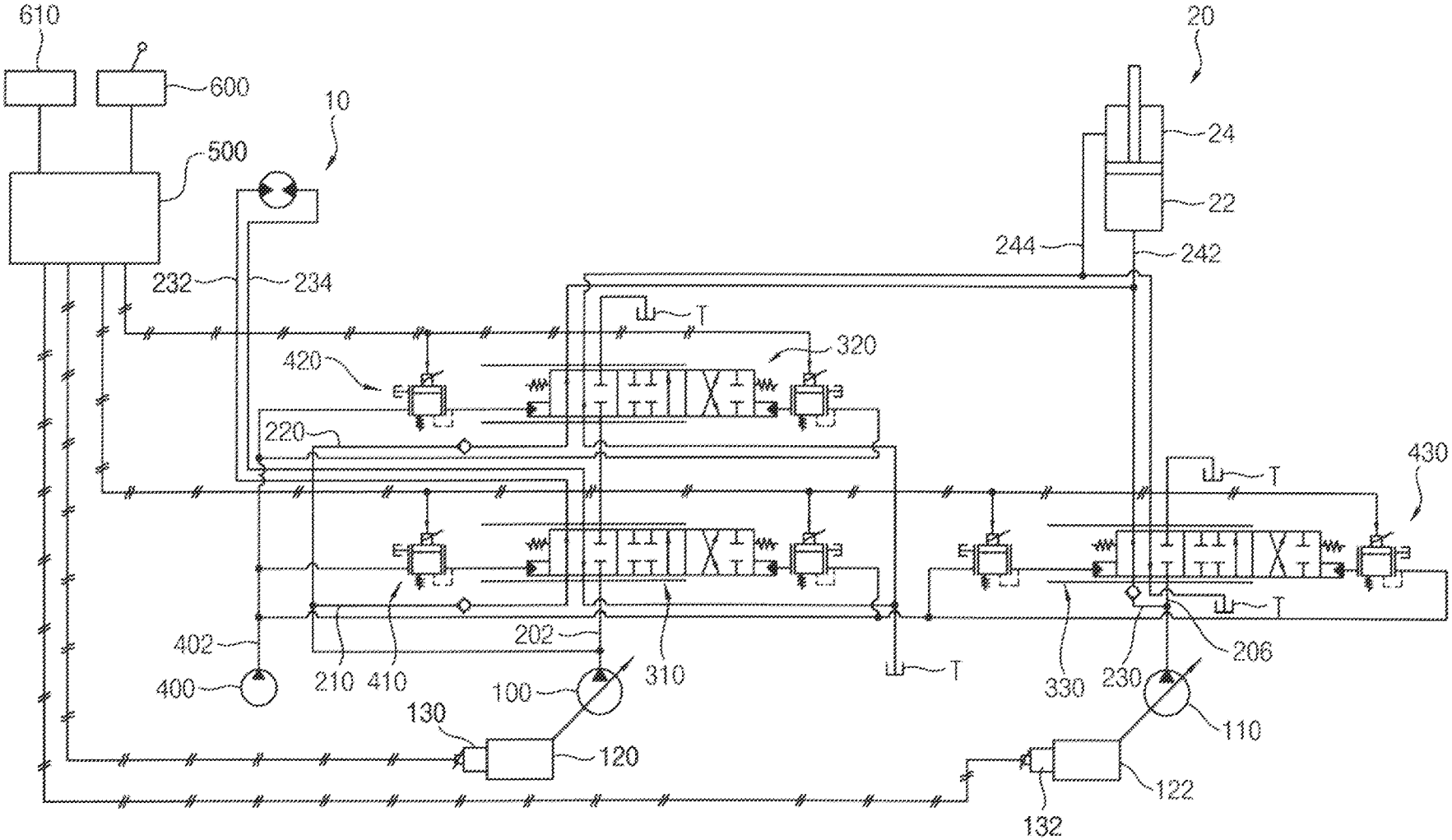
FIG. 7 is a hydraulic circuit diagram illustrating the control system in FIG. 1 where a multiple operation signal of boom up operation and upper body swing operation is received.

FIG. 1 is a hydraulic circuit diagram illustrating a control system for construction machinery in accordance with example embodiments. FIG. 2 is a block diagram illustrating a controller of the control system in FIG. 1. FIG. 3 is a graph illustrating a swing joystick displacement limit map according to a limiting ratio selected by an operator, which is stored in the controller in FIG. 2. FIG. 4 is a graph illustrating a boom joystick displacement limit map according to a secondary swing joystick displacement in FIG. 3. FIG. 5 is a graph illustrating a conversion ratio of a boom joystick displacement according to the boom joystick displacement limit map in FIG. 4. FIG. 6 is a graph illustrating a boom height to a swing angle in a pump horsepower distribution control and a pump horsepower distribution/spool displacement control. FIG. 7 is a hydraulic circuit diagram illustrating the control system in FIG. 1 where a multiple operation signal of boom up operation and upper body swing operation is received.

Referring to FIGS. 1 to 7, a control system for construction machinery may include a first hydraulic pump 100, first and second actuators 10 and 20 connected to the first hydraulic pump 100 through first and second parallel lines 210 and 220 respectively and operable by a working oil discharged from the first hydraulic pump 100, first and second control valves 310 and 320 installed in the first and second parallel lines 210 and 220 respectively and configured to control operations of the first and second actuators 10 and 20, first and second spool displacement adjusting valves 410, 420 supplying pilot signal pressures to spools of the first and second control valves 310 and 320 respectively in proportion to an inputted control signal to control displacement amounts of the spools of the first and second control valves 310 and 320, and a controller 500 configured to output the control signal to each of the first and second spool displacement adjusting valves 410, 420 corresponding to a manipulation signal of an operator and configured to control the operation of one of the first and second actuators 10 and 20 according to the manipulation signal of the other of the first and second actuators 10 and 20.

In example embodiments, the construction machinery may include an excavator, a wheel loader, a forklift, etc. Hereinafter, it will be explained that example embodiments may be applied to the excavator. However, it may not be limited thereto, and it may be understood that example embodiments may be applied to other construction machinery such as the wheel loader, the forklift, etc.

The construction machinery may include a lower travelling body, an upper swinging body mounted to be capable of swinging on the lower travelling body, and a cabin and a front working device installed in the upper swinging body. The front working device may include a boom, an arm and a bucket. A boom cylinder for controlling a movement of the boom may be installed between the boom and the upper swinging body. An arm cylinder for controlling a movement of the arm may be installed between the arm and the boom. A bucket cylinder for controlling a movement of the bucket may be installed between the bucket and the arm. A swing motor for controlling the upper swing body may be installed between the upper swinging body and the lower travelling body.

In example embodiments, the first hydraulic pump 100 may be connected to an engine (not illustrated) through a power take off (PTO) such that a power of the engine may be transferred to the first hydraulic pump 100. The working oil discharged from the first hydraulic pump 100 may be supplied to the first and second actuators 10 and 20 through the first and second control valves 310 and 320 respectively.

In particular, the first and second control valves 310 and 320 may be connected to the first hydraulic pump 100 through a first main hydraulic line 200. The first main hydraulic line 200 may be divided into a first center bypass line 202 and the first and second parallel lines 210 and 220. The first and second control valves 310, 320 may be installed sequentially in the first center bypass line 202.

The first and second control valves 310 and 320 may be installed respectively in the first and second parallel lines 210 and 220 which are connected to the first hydraulic pump 100 in parallel with each other. Even though the first control valve 310 is switched to close the first center bypass line 202, the second control valve 320 may be connected to the first hydraulic pump 100 by the second parallel line 220 such that the working oil discharged from the first hydraulic pump 100 may be supplied to the second control valve 320. Since the first and second control valves 310, 320 are connected respectively to the first and second parallel lines 210, 220 which are connected in parallel to the first hydraulic pump 100, when the first and second control valves 310 and 320 are switched, the working oil discharged from the first hydraulic pump 100 may be supplied to the first and second actuators 10 and 20 through the first and second control valves 310 and 320 respectively.

Although it is not illustrated in the figures, an auxiliary control valve for controlling an operation of a third actuator may be installed in the first center bypass line 202, and the working oil discharged from the first hydraulic pump 100 may be supplied to the third actuator through the auxiliary control valve. In this case, a parallel line similar to the first and second parallel lines 210, 220 may be connected to the auxiliary control vale.

In example embodiments, the first actuator 10 may be the swing motor, and the second actuator 20 may be the boom cylinder. In this case, the first control valve 310 may be a swing control valve, and the second control valve 320 may be a boom control valve. Alternatively, the first actuator 10 may be the boom cylinder, and the second actuator 20 may be the swing motor. In this case, the first control valve 310 may be the boom control valve, and the second control valve 320 may be the swing control valve.

The first control valve 310, that is, the swing control valve may be connected to the first actuator 10, that is, A port and B port of the swing motor through a first swing hydraulic line 232 and a second swing hydraulic line 234. Accordingly, the first control valve 310 may be switched to selectively supply the working oil discharged from the first hydraulic pump 100 to the A port and the B portion of the swing motor, to thereby control a rotation direction and a rotational speed of the upper swing body.

The working oil which drives the swing motor 10 may return to a drain tank T through a return hydraulic line. For example, the working oil from the A port and the B port of the swing motor may be drained to the drain tank T through the first hydraulic line 234 and the second hydraulic line 234 via the first control valve 310, that is, the swing control valve.

The second control valve 320, that is, the boom control valve may be connected to the second actuator 20, that is, a boom head chamber 22 and a boom rod chamber 24 of the boom cylinder 20 through a boom head hydraulic line 242 and a boom rod hydraulic line 244. Accordingly, the second control valve 320 may be switched to selectively supply the working oil discharged from the first hydraulic pump 100 to the boom head chamber 22 and the boom rod chamber 24.

The working oil which drives the boom cylinder 20 may return to the drain tank T through a return hydraulic line. For example, the working oil from the boom head chamber 22 and the boom rod chamber 24 may be drained to the drain tank T through the boom head hydraulic line 242 and the boom rod hydraulic line 244 via the second control valve 320, that is, the boom control valve.

On the other hand, when there is no manipulation signals for the first and second actuators 10, 20, the working oil from the first hydraulic pump 100 may return to the drain tank T through the first center bypass line 202.

In example embodiments, a pilot pump 400 may be connected to an output axis of the engine. As the output axis of the engine rotates, the pilot pump 400 may be driven to discharge a pilot working oil. For example, the pilot pump may include a gear pump. In this case, the working oil and the pilot working oil may include substantially the same material.

The pilot working oil discharged from the pilot pump 400 may be supplied to the spools of the first and second control valves 310, 320 via the first and second spool displacement adjusting valves 410, 420 respectively. The pilot working oil discharged from the pilot pump 400 may be supplied to the first and second spool displacement adjusting valves 410, 420 through a control line 402.

The first and second spool displacement adjusting valves 410, 420 may supply the pilot signal pressures to the spools of the first and second control valves 310, 320 in proportion to the inputted control signal respectively to control the displacement amounts of the spools of the first and second control valve 310, 320.

For example, a pair of the first spool displacement adjusting valves 410 may be provided in both sides of the spool of the first control valve 310. A first pilot signal pressure outputted from the first spool displacement adjusting valve 410 may be supplied selectively to both sides of the spool, to switch the first control valve 310. The first spool displacement adjusting valve 410 may supply the first pilot signal pressure in proportion to the inputted control signal. The movement of the spool of the first control valve 310 may be controlled by the first pilot signal pressure. That is, the movement direction of the spool may be determined by a supply direction of the first pilot signal pressure, and the displacement amount of the spool may be determined by the magnitude of the first pilot signal pressure.

Additionally, a pair of the second spool displacement adjusting valves 420 may be provided in both sides of the spool of the second control valve 320. A second pilot signal pressure outputted from the second spool displacement adjusting valve 420 may be supplied selectively to both sides of the spool, to switch the second control valve 320. The second spool displacement adjusting valve 420 may supply the second pilot signal pressure in proportion to the inputted control signal. The movement of the spool of the second control valve 320 may be controlled by the second pilot signal pressure. That is, the movement direction of the spool may be determined by a supply direction of the second pilot signal pressure, and the displacement amount of the spool may be determined by the magnitude of the second pilot signal pressure.

In example embodiments, the control system for construction machinery may include a main control valve (MCV) as an assembly including the first and second control valves 310 and 320. The main control valve may be an electro-hydraulic main control valve including an electro proportional pressure reducing valve (EPPRV) which controls a pilot working oil supplied to the spool of the control valve according to an inputted electrical signal. The first and second spool displacement adjusting valves 410, 420 may include an electro proportional pressure reducing valve (EPPRV).

In example embodiments, the controller 500 may include a control valve control portion 520 for controlling the control valves and a pump control portion 530 for controlling the hydraulic pump.

The control valve control portion 520 may receive the manipulation signal in proportion to a manipulation amount of an operator from a manipulation portion 600, and may output a pressure command signal as the control signal to the first and second spool displacement adjusting valves 410, 420 corresponding to the manipulation signal. The electro proportional pressure reducing valves may output a secondary pressure in proportion to the pressure command signal to the corresponding spools, to control the spools using electrical signals.

For example, the control valve control portion 520 may receive a manipulation signal for the first actuator 10, for example, a first joystick displacement amount, and generate and apply a control signal corresponding to the first joystick displacement amount, for example, current to the first spool displacement adjusting valve 410. The first spool displacement adjusting valve 410 may supply a first pilot signal pressure in proportion to the applied current to the spool of the first control valve 310 to move the spool according to the supplied first pilot signal pressure. Accordingly, the first joystick displacement amount for the first actuator 10 may be converted into a spool displacement amount of the first control valve 310 at a predetermined conversion ratio.

The control valve control portion 520 may receive a manipulation signal for the second actuator 20, for example, a second joystick displacement amount, and generate and apply a control signal corresponding to the second joystick displacement amount, for example, current to the second spool displacement adjusting valve 420. The second spool displacement adjusting valve 420 may supply a second pilot signal pressure in proportion to the applied current to the spool of the second control valve 320 to move the spool according to the supplied second pilot signal pressure.

Accordingly, the second joystick displacement amount for the second actuator 20 may be converted into a spool displacement amount of the second control valve 320 at a predetermined conversion ratio.

For example, the manipulation portion 600 may include a joystick, a pedal, etc. When an operator manipulates the manipulation portion 600, a manipulation signal corresponding to the manipulation may be generated. The manipulation portion 600 may include a sensor for detecting the joystick displacement amount (or angle). The manipulation portion 600 may output a signal such as a voltage signal or a current signal corresponding to the detected displacement amount. The controller 500 may receive the manipulation signal and control the main control valve corresponding to the manipulation signal, to operate the first and second actuators.

In example embodiments, the control system for construction machinery may further include a second hydraulic pump 110 for supplying a working oil to the second actuator 20, a third control valve 330 installed in a hydraulic line between the second actuator 20 and the second hydraulic pump 110 and configured to control an operation of the second actuator 10, and a third spool displacement adjusting valve 430 supplying a pilot signal pressure to a spool of the third control valve 330 respectively in proportion to an inputted control signal to control a displacement amount of the spool of the third control valve 330.

In example embodiments, the second hydraulic pump 110 may be connected to the engine which drives the first hydraulic pump 100. The power of the engine may be distributed to the first and second hydraulic pumps 100, 110 at a predetermined ratio by the pump control portion 520 as described later.

The working oil discharged from the second hydraulic pump 110 may be supplied to the second actuator 20 through the third control valve 330. In particular, the third control valve 330 may be connected to the second hydraulic pump 110 through a second main hydraulic line 204. The second main hydraulic line 204 may be divided into a second center bypass line 206 and a third parallel line 230. The third control valve 330 and an auxiliary control valve (not illustrated) may be sequentially installed in the second center bypass line 206.

The third control valve 330 may be connected to the second actuator 20, that is, the boom head chamber 22 and the boom head chamber 24 of the boom cylinder through the boom head hydraulic line 242 and the boom rod hydraulic line 244. Accordingly, the third control valve 330 may be switched to selectively supply the working oil discharged from the second hydraulic pump 110 to the boom head chamber 22 and the boom rod chamber 24. Thus, the working oil discharged from the first and second hydraulic pumps 100, 110 may be joined through the first and third control valves 310, 330 to be supplied to the second actuator 20. In case that the second actuator 20 performs a heavy load work, the working oil discharged from the first and second hydraulic pumps 100, 110 may be joined.

In case that there is no manipulation signal for the second actuator 20, the working oil discharged from the second hydraulic pump 110 may return to the drain tank T.

The pilot working oil discharged from the pilot pump 400 may be supplied to a spool of the third control valve 330 via the third spool displacement adjusting valve 430. The pilot working oil discharged from the pilot pump 400 may be supplied to the third spool displacement adjusting valve 430 through the control line 402.

The third spool displacement adjusting valve 430 may supply the pilot signal pressure to the spool of the third control valve 330 in proportion to the inputted control signal to control the displacement amount of the spool of the third control valve 330.

For example, a pair of the third spool displacement adjusting valves 430 may be provided in both sides of the spool of the third control valve 330. A third pilot signal pressure outputted from the third spool displacement adjusting valve 430 may be supplied selectively to both sides of the spool, to switch the third control valve 330. The third spool displacement adjusting valve 430 may supply the third pilot signal pressure in proportion to the inputted control signal. The movement of the spool of the third control valve 330 may be controlled by the third pilot signal pressure. That is, the movement direction of the spool may be determined by a supply direction of the third pilot signal pressure, and the displacement amount of the spool may be determined by the magnitude of the third pilot signal pressure.

In example embodiments, the third spool displacement adjusting valve 430 may include an electro proportional pressure reducing valve (EPPRV).

The control valve control portion 520 may receive a manipulation signal for the second actuator 20, for example, the second joystick displacement amount, and generate and apply a control signal corresponding to the second joystick displacement amount, for example, current to the third spool displacement adjusting valve 430. The third spool displacement adjusting valve 430 may supply the third pilot signal pressure in proportion to the applied current to the spool of the third control valve 330 to move the spool according to the supplied third pilot signal pressure. Accordingly, the second joystick displacement amount for the second actuator 20 may be converted into a spool displacement amount of the third control valve 330 at a predetermined conversion ratio.

In example embodiments, the control system for construction machinery may further include a first swash plate angle adjusting unit to adjust a swash plate angle of the first hydraulic pump 100 according to an inputted pump control signal to control a discharged amount of the working oil of the first hydraulic pump 100 and a second swash plate angle adjusting unit to adjust a swash plate angle of the second hydraulic pump 110 according to an inputted pump control signal to control a discharge amount of the working oil of the second hydraulic pump 110.

In particular, the first swash plate angle adjusting unit may include a first regulator 120 to adjust the swash plate angle of the first hydraulic pump 100 according to an inputted pilot pressure and a first electro proportional pressure reducing valve 130 for controlling and outputting the pilot pressure to the first regulator 120. The second swash plate angle adjusting unit may include a second regulator 122 to adjust the swash plate angle of the second hydraulic pump 110 according to an inputted pilot pressure and a second electro proportional pressure reducing valve 132 for controlling and outputting the pilot pressure to the second regulator 122.

The first regulator 120 may be connected to the pilot pump 400 via the first electro proportional pressure reducing valve 130, and the second regulator 122 may be connected to the pilot pump 400 via the second electro proportional pressure reducing valve 132.

When the pump control signal having a relatively high current command value is inputted to the first electro proportional pressure reducing valve 130, the pilot pressure inputted to the first regulator 120 may be increased so that the discharge amount of the working oil of the first hydraulic pump 100 may be decreased. When the pump control signal having a relatively high current command value is inputted to the second electro proportional pressure reducing valve 132, the pilot pressure inputted to the second regulator 122 may be increased so that the discharge amount of the working oil of the second hydraulic pump 110 may be decreased. That is, as the current command value of the pump control signal is reduced, the discharged amount of the hydraulic pump may be increased and thus a discharged pressure of the hydraulic pump may be increased, while as the current command value of the pump control signal is increased, the discharged amount of the hydraulic pump may be decreased and thus the discharged pressure of the hydraulic pump may be decreased.

In example embodiments, when the control valve control portion 520 receives a manipulation signal for a multiple operation of the first and second actuators 10, 20, the control valve control portion 520 may control to limit a maximum allowable valve of the manipulation signal for the first actuator 10 to a value selected by an operator and to limit the spool displacement amount of the second control valve 320 in response to the manipulation signal for the second actuator 20 based on the manipulation signal for the first actuator 10. The control valve control portion 520 may convert the amount of the manipulation signal for the first actuator 10 at a ratio selected by an operator and may output a control signal which decrease a conversion ratio of the manipulation signal for the second actuator 20, that is, a ratio of the spool displacement amount of the second control valve 320 with respect to the joystick displacement amount for the second actuator 20 in proportion to the converted joystick displacement amount for the first actuator 10 is decreased in proportion to the converted amount of the manipulation signal for the first actuator 10, to the second spool displacement adjusting valve 420.

As illustrated in FIG. 2, the controller 500 may include a data receiver 510, the control valve control portion 520 and the pump control portion 530.

The data receiver 510 may receive a joystick displacement from the manipulation portion 600, and may receive a joystick displacement limiting ratio, a horsepower distribution ratio, etc, selected by an operator, from a user selection portion 610. The data receiver 510 may receive a multiple operation working condition inputted by an operator, from the user selection portion 610. The data receiver 510 may receive the joystick displacement amount as the manipulation signal for the boom, the arm, the bucket, etc. For example, the data receiver 510 may receive a boom joystick displacement amount (boom stroke) as the manipulation signal for the boom cylinder and a swing joystick displacement amount (swing stroke) as the manipulation signal for the swing motor.

For example, the user selection portion 610 may be a user input device for performing spool displacement control function and pump horsepower distribution control function within a range selected by an operator. The user selection portion 610 may be a user input device for inputting a working condition of the multiple operation which an operator desires to perform. The user selection portion 610 may be embodied as various devices such as touch display, toggle button, etc. The data receiver 510 may be in communication with the user selection portion 610 to receive parameters selected by an operator.

The data receiver 510 may receive discharge pressures and swash plate angles of the first and second hydraulic pumps 100 and 110. The data receiver 510 may receive information such as an engine rotational speed (rpm), an output power, etc, from an engine control unit (ECU).

The control valve control portion 520 may include a first joystick displacement converter 522, a second joystick displacement converter 524 and an output portion 526.

The first joystick displacement converter 522 may convert the inputted first joystick displacement amount for the first actuator 10 into a secondary first joystick displacement amount having a value reduced at the limiting ratio selected by an operator.

As illustrated in FIG. 3, the first joystick displacement converter 522 may convert the inputted swing joystick displacement amount (swing stroke) into the secondary swing joystick displacement amount at the limiting ratio selected by an operator using a displacement limit map. In case that the limiting ratio selected by an operator is 20% (that is, maximum allowable value is 80%), the inputted swing joystick displacement (0~100%) may be mapped into the secondary swing joystick displacement (0~80%). In this case, the maximum allowable value (80%) of the secondary swing joystick displacement may have a valve which is reduced 20% from a maximum allowable value (100%) of the inputted swing joystick displacement. Alternatively, in case that the limiting ratio selected by an operator is 20%, 80% or more of the inputted swing joystick displacement may be converted into 80%.

The second joystick displacement converter 524 may convert the inputted second joystick displacement amount for the second actuator into the secondary second joystick displacement amount having a value that is reduced in proportion to the secondary first joystick displacement of the first actuator 10.

As illustrated in FIG. 4, the secondary joystick displacement converter 524 may convert the inputted boom joystick displacement (boom stroke) into the secondary boom joystick displacement using a displacement limit map. The decreasing rate of the secondary boom joystick displacement amount with respect to the inputted boom joystick displacement amount may be proportional to the secondary swing joystick displacement amount (limited swing stroke). That is, as the value of the limited swing stroke is increased, the converted secondary boom joystick displacement amount may be decreased.

The output portion 526 may output the control signal for controlling the pilot signal pressure in proportion to the converted (limited) secondary swing joystick displacement amount and the secondary boom joystick displacement amount. The output portion 526 may generate and apply current in proportion to the converted secondary swing joystick displacement amount to the first spool displacement adjusting valve 410 and generate and apply current in proportion to the converted secondary boom joystick displacement amount to the second spool displacement adjusting valve 420. The first and second spool displacement adjusting valves 410, 420 may supply the first and second pilot signal pressures in proportion to the applied current to the spools of the swing control valve and the boom control valve to move the spools of the swing and boom control valves corresponding to the applied first and second pilot signal pressures.

Accordingly, an orifice area of the swing control valve may be limited at the limiting ratio selected by an operator and an orifice area of the boom control valve may be controlled to be in inverse proportion to the size of the limited swing joystick displacement. That is, the orifice area of the swing control valve according to the converted secondary swing joystick displacement amount may be controlled to be less than the orifice area of the swing control valve in case that the swing joystick displacement is not converted, and the orifice area of the boom control valve according to the converted secondary boom joystick displacement amount may be controlled to be less than the orifice area of the boom control valve in case of a single operation of the boom, and the decreasing ratio of the orifice area of the boom control valve may be in proportion to the size of the secondary swing joystick displacement. Further, the orifice area of the boom control valve according to the converted secondary boom joystick displacement may be controlled to be greater than the orifice area of the boom control valve in case that the swing joystick displacement is not converted.

As illustrated in FIG. 5, as the secondary swing joystick displacement amount is adjusted, the spool displacement amount for the manipulation signal of the boom control valve may be adjusted. The conversion ratio of the spool displacement amount of the boom control valve to the boom manipulation signal (conversion ratio of the boom manipulation signal) may be decreased in proportion to the size of the swing stroke (that is, limited swing joystick displacement amount). The conversion ratio of the boom manipulation signal in the multiple operation of the upper swinging body swing operation and the boom up operation may be less than the conversion ratio of the boom manipulation signal in the single operation of the boom. For example, when the swing stroke (secondary swing joystick displacement amount) is 100%, the conversion ratio of the spool displacement amount of the boom control valve to the inputted boom joystick displacement amount may be decreased to about 50% of the conversion ratio in the single operation of the boom.

The pump control portion 530 may include a horsepower distribution ratio calculator 532 and an output portion 534.

The horsepower distribution ratio calculator 532 may calculate target horsepower values for controlling a horsepower distribution ratio of the first and second hydraulic pumps 100, 110 according to a horsepower limiting ratio selected by an operator. Alternatively, the horsepower distribution ratio calculator 532 may provide a horsepower distribution ratio calculated according to manipulation signals of the joystick or provide an operation mode having a torque distribution ratio predetermined according to kinds of the multiple operations as Table 1 below.

TABLE 1

| operation mode | kinds of multiple operations | first pump torque distribution ratio (%) | second pump torque distribution ratio (%) |
|---|---|---|---|
| 1 | boom up, bucket operation | 55 | 45 |
| 2 | boom down, bucket operation | 50 | 50 |
| 3 | arm crowd, swinging body swing | 50 | 50 |
| 4 | arm dump, swinging body swing | 30 | 70 |
| 5 | boom up, arm operation | 50 | 50 |
| 6 | boom up, swinging body swing | 70 | 30 |
| 7 | bucket operation, arm operation | 50 | 50 |

The output portion 534 may output the pump control signals for controlling the pilot signal pressure inputted to the first and second regulators 120, 122 according to the horsepower distribution ratio. The output portion 534 may generate and apply current corresponding to the target horsepower values determined according to the horsepower distribution ratio to the first and second electro proportional pressure reducing valves 30, 132. The first and second electro proportional pressure reducing valves 130, 132 may supply the pilot signal pressure in proportion to the applied current to the first and second regulators 120, 122 respectively to thereby control the discharged amount of the working oil and the discharged pressure of the first and second hydraulic pumps 100, 110.

In example embodiments, a range of the limiting ratio of the manipulation signal selected by an operator may be determined according to the horsepower distribution ratio. When a maximum discharged amount of the working oil of the first hydraulic pump 100 is determined according to the horsepower distribution ratio, the range of the limiting ratio of the swing joystick displacement may be determined in order to prevent cavitation in the maximum discharge amount. Thus, an operator may select the limiting ratio within the range of the limiting ratio determined through the user selection portion 610.

As mentioned above, in the multiple operation the horsepower distribution ratio of the first and second hydraulic pumps 100, 110 may be adjusted (pump power distribution control), to control working speeds of the first and second actuators 10, 20. For example, in the multiple operation of the boom and the swing motor the horsepower ratio of the first hydraulic pump 100 and the second hydraulic pump 110 may be adjusted to be increased or decreased, to increase or decrease the working speed of the swing motor relative to the working speed of the boom.

Additionally, in the multiple operation the manipulation signal for the first actuator 10 may be limited at a ratio selected by an operator and the manipulation signal for the second actuator 20 may be controlled to be limited according to the limited manipulation signal for the first actuator 10 (spool displacement control), to control working speeds of the first and second actuators 10, 20. For example, in the multiple operation of the boom and the swing motor the swing joystick displacement for the swing motor 10 may be limited, to control that the working speed of the swing motor according to the limited swing joystick displacement may be greater than the working speed of the swing motor in case that the swing joystick displacement is not limited.

As illustrated in FIG. 6, a range Rb of a boom height according to a swinging body swing angle in the pump horsepower distribution/spool displacement control may be greater than a range Ra of the boom height according to the swinging body swing angle in the pump horsepower distribution control.

For example, in case that only the pump horsepower distribution control is performed, the boom up height during a first angle rotation of the swinging body may be controlled within a first range. On the other hand, in case that both of the pump horsepower distribution control and the spool displacement control are performed, the boom up height during the identical first angle rotation of the swinging body may be controlled within a second range wider than the first range.

In case that an excavator loads a material into a dump truck which is positioned at 45 degrees of the angle rotation of a swing body, since the swing distance is relatively short, work efficiency may be improved better when an operating speed of the boom is controlled to be relatively greater than an operating speed of the swing motor, while in case that the excavator loads a material into the dump truck which is positioned 180 degrees of the angle rotation of the swing body, since the swing distance is relatively long, work efficiency may be improved better when the operating speed of the swing motor is controlled to be relatively greater than the operating speed of the boom.

For example, in case that an excavator loads a material into a dump truck which is positioned at 45 degrees, the pump horsepower distribution control and the spool displacement control are performed such that the boom height follows graph G1 in FIG. 6. In case that the excavator loads a material into the dump truck which is positioned at 90 degrees, the pump horsepower distribution control and the spool displacement control are performed such that the boom height follows graph G2 in FIG. 6. In case that the excavator loads a material into the dump truck which is positioned at 180 degrees, the pump horsepower distribution control and the spool displacement control are performed such that the boom height follows graph G3 in FIG. 6.

Accordingly, when enough efficiency of the multiple operation of the boom and the swing motor under only the pump horsepower distribution control is not expected, swing and boom orifice areas may be adjusted through the spool displacement control, to increase the operation range of the swing motor or the boom.

In example embodiments, the data receiver 510 may receive a specific working condition of the multiple operation inputted from the user selection portion 610, and determine the limiting ratio or the limiting ratio range for optimizing the efficiency of the multiple operation. When the limiting ratio is determined, the control valve control portion 520 may limit the maximum size of the manipulation signal for the first actuator 10 at the predetermined limiting ratio and adjust the spool displacement of the second control valve 320 in response to the manipulation signal for the second actuator 20 based on the limited manipulation signal for the first actuator 10. When the limiting ration range is determined, an operator may select the limiting ratio within the predetermined limiting ratio range through the user selection portion 610.

For example, an operator may input a loading work condition (rotation angle of the swinging body, height of the boom) to be performed through the user selection portion 610. An operator may grasp intuitively and input information on an excavation position, a truck position and a truck height, etc of the loading work to be performed, through the user selection portion 610 without selecting the limiting ratio. In this case, the controller 500 may determine the limiting ratio for optimizing the efficiency of the loading work, and in the multiple operation of the boom and the swing motor, may limit the swing joystick displacement for the swing motor 10 and adjust the conversion ratio of the manipulation signal for the boom 20 in inverse proportion to the size of the limited swing joystick displacement.

As mentioned above, the control system for construction machinery may control the horsepower distribution ratio of the first and second hydraulic pumps 100, 110 according to the horsepower distribution ratio selected by an operator, and may limit the spool displacement of the swing control valve 310 according to the limiting ratio of the swing joystick displacement selected by an operator to control the swing orifice area. Further, the control system for construction machinery may limit the spool displacement of the boom control valve 320 according to the limited swing joystick displacement to control the boom orifice area.

Accordingly, an orifice area ratio of the hydraulic lines though which the working oil is supplied to the actuators may be controlled by performing the pump power distribution control and the spool displacement control of the control valve using EPPRV, a speed balance between the actuators may be adjusted to match user's situation in a variety of working conditions. Thus, user convenience may be improved and work efficiency may be maximized.

Hereinafter, a control method for construction machinery using the control system in FIG. 1 will be explained.

Figure 8:
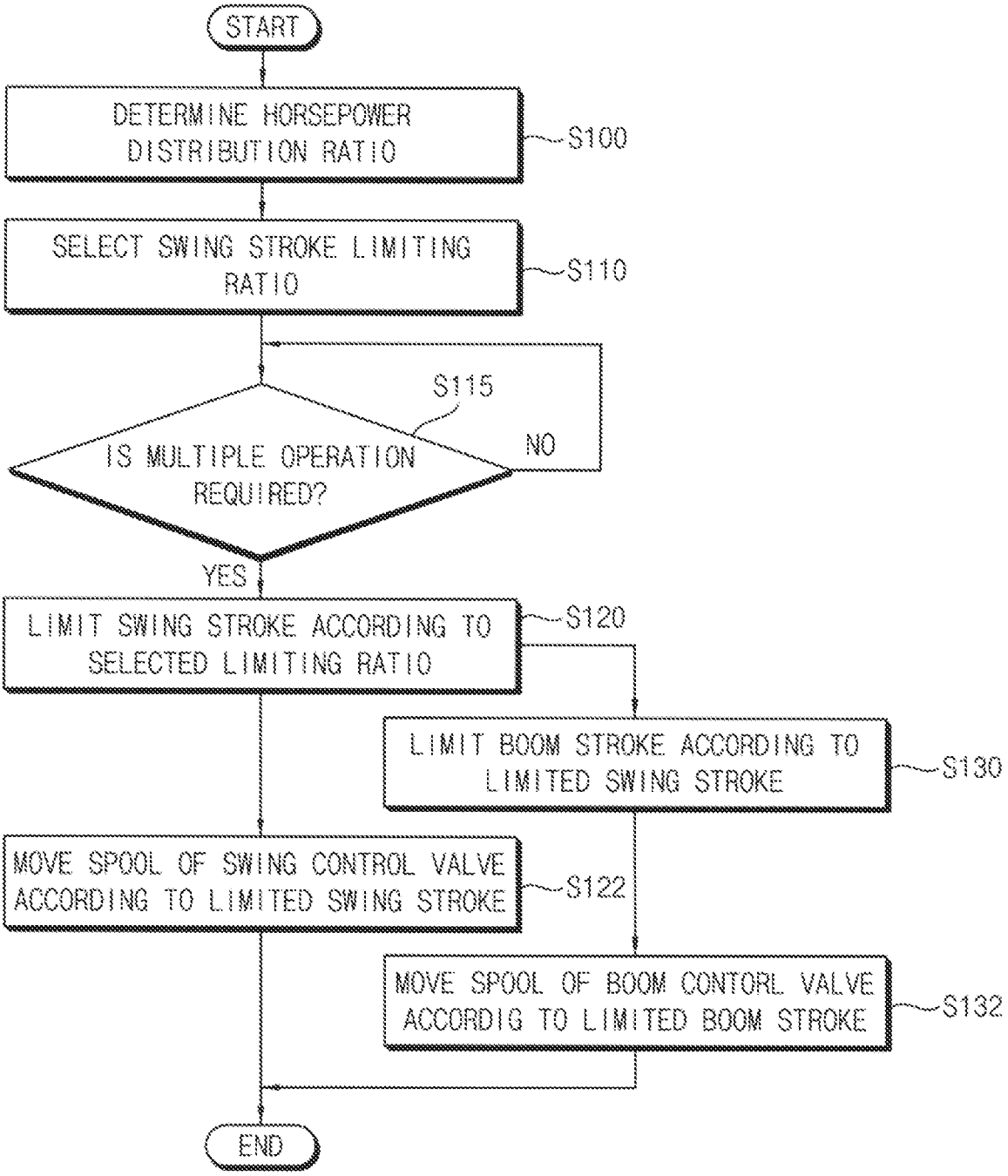
FIG. 8 is a flow chart illustrating a control method for construction machinery in accordance with example embodiments.

FIG. 8 is a flow chart illustrating a control method for construction machinery in accordance with example embodiments.

Referring to FIGS. 1, 2 and 8, a manipulation signal of an operator for first and second actuators 10 and 20, a limiting ratio value for the manipulation signal of the first actuator 10 selected by an operator, and a horsepower distribution ratio value for first and second hydraulic pumps 100, 110 selected by an operator may be received (S100, S110).

In example embodiments, an operator may input the manipulation signal for the first and second actuators 10, 20 through a manipulation portion 600. An operator may select and input the pump horsepower distribution ratio for the first and second hydraulic pumps 100, 110 through a user selection portion 610. An operator may select and input the limiting ratio for the manipulation signal of the first actuator 10 through the user selection portion 610.

Additionally, an operator may input a specific working condition of a multiple operation to be performed, through the user selection portion 610. In this case, the limiting ratio or a limiting ratio range for optimizing efficiency of the multiple operation may be determined based on the inputted working condition of the multiple operation. For example, when an operator inputs a loading work condition (rotation angle of a swinging body, height of a boom, etc) to be performed, a controller 500 may determine the optimal limiting ratio or may determine the optimal limiting ratio range and an operator may select a limiting ratio value within the predetermined limiting ratio range.

Then, when the manipulation signal or the multiple operation of the first and second actuators 10, 20 is received (S115), a maximum value of the manipulation signal for the first actuator 10 may be limited according to the limiting ratio (S120), and then, a spool of a first control valve 310 may be moved according to the limited manipulation signal for the first actuator 10 (S122).

In example embodiments, first, whether or not a multiple operation is required to be performed may be determined based on the multiple manipulation signal for the first and second actuators 10, 20 through the manipulation portion 600, and in the multiple operation, the maximum value of the manipulation signal for the first actuator 10 may be limited at the limiting ration selected by an operator and a spool displacement of a second control valve 320 in response to the manipulation for the second actuator 20 may be limited according to the limited manipulation signal for the first actuator 10.

For example, an inputted swing joystick displacement (swing stroke) may be converted into a secondary swing joystick displacement at the limiting ratio selected by an operator or the determined optimal limiting ratio. In case that the limiting ratio selected by an operator is 20% (that is, maximum allowable value is 80%), the inputted swing joystick displacement (0~100%) may be mapped into the secondary swing joystick displacement (0~80%). In this case, the maximum allowable value (80%) of the secondary swing joystick displacement may have a valve which is reduced 20% from a maximum allowable value (100%) of the inputted swing joystick displacement.

Then, current may be generated in proportion to the converted secondary swing joystick displacement amount and may be supplied to a first spool displacement adjusting valve 410. The first spool displacement adjusting valve 410 may supply a first pilot signal pressure in proportion to the applied current to the spool of the swing control valve to move the spool of the swing control valve corresponding to the applied first pilot signal pressure.

Then, an inputted manipulation signal for the second actuator 20 may be limited according to the limited manipulation signal form the first actuator 10 (S130), and then, a spool of a second control valve 320 may be moved according to the limited manipulation signal for the second actuator 20 (S132).

For example, an inputted boom joystick displacement (boom stroke) may be converted into a secondary boom joystick displacement using a displacement limiting map. A decreasing rate of the secondary boom joystick displacement amount with respect to the inputted boom joystick displacement amount may be proportional to the secondary swing joystick displacement amount (limited swing stroke). That is, as the value of the limited swing stroke is increased, the converted secondary boom joystick displacement amount may be decreased.

Then, current may be generated in proportion to the converted secondary boom joystick displacement amount and may be supplied to a second spool displacement adjusting valve 420. The second spool displacement adjusting valve 420 may supply a second pilot signal pressure in proportion to the applied current to the spool of the boom control valve to move the spool of the boom control valve corresponding to the applied second pilot signal pressure.

As the boom joystick displacement amount is adjusted, the spool displacement amount for the manipulation signal of the boom control valve may be adjusted. That is, the conversion ratio of the spool displacement amount of the boom control valve to the boom manipulation signal (conversion ratio of the boom manipulation signal) may be decreased in proportion to the size of the swing stroke. The conversion ratio of the boom manipulation signal in the multiple operation may be less than the conversion ratio of the boom manipulation signal in the single operation of the boom. For example, when the swing stroke is 100%, the conversion ratio of the spool displacement amount of the boom control valve to the inputted boom joystick displacement amount may be decreased to about 50% of the conversion ratio in the single operation of the boom.

As mentioned above, the horsepower distribution ratio of the first and second hydraulic pumps 100, 110 may be controlled according to the horsepower distribution ratio selected by an operator, and the spool displacement of the swing control valve 310 may be limited according to the limiting ratio of the swing joystick displacement selected by an operator to control the swing orifice area. Further, the spool displacement of the boom control valve 320 may be limited according to the limited swing joystick displacement to control the boom orifice area.

Accordingly, an orifice area ratio of the hydraulic lines though which the working oil is supplied to the actuators may be controlled by performing the pump power distribution control and the spool displacement control of the control valve using EPPRV, a speed balance between the actuators may be adjusted to match user's situation in a variety of working conditions. Thus, user convenience may be improved and work efficiency may be maximized.

The present invention has been explained with reference to preferable embodiments, however, those skilled in the art may understand that the present invention may be modified or changed without being deviated from the concept and the scope of the present invention disclosed in the following claims.

THE DESCRIPTION OF THE REFERENCE NUMERALS

10: first actuator 20: second actuator
22: boom head chamber 24: boom rod chamber
100: first hydraulic pump 110: second hydraulic pump
200: main hydraulic line 202: first center bypass line
204: second center bypass line 210: first parallel line
220: second parallel line 230: third parallel line
232: first swing hydraulic line 234: second swing hydraulic line
310: first control valve 320: second control valve
330: third control valve 400: pilot pump
402: control line 410: first spool displacement adjusting valve
420: second spool displacement adjusting valve 430: third spool displacement adjusting valve
500: controller 510: data receiver
520: control valve control portion 522: first joystick displacement converter
524: second joystick displacement converter 526: output portion
530: pump control portion 532: horsepower distribution ratio calculator
534: output portion 600: manipulation portion
610: user selection portion

The invention claimed is:

1. A control system for construction machinery, comprising:

a first hydraulic pump;

a second hydraulic pump;

first and second actuators connected to the first hydraulic pump through first and second parallel lines respectively and operable by a working oil discharged from the first hydraulic pump;

first and second control valves installed in the first and second parallel lines respectively and configured to control operations of the first and second actuators;

first and second spool displacement adjusting valves configured to supply pilot signal pressures to spools of the first and second control valves in proportion to inputted control signals to control displacement amounts of the spools of the first and second control valves;

a data receiver configured to receive a working condition selected by an operator and determine a limiting ratio based on the working condition, and receive an inputted joystick displacement amount for the first actuator and an inputted joystick displacement amount for the second actuator;

a pump control portion; and a control valve control portion, wherein the control valve control portion comprises a first joystick converter configured to convert the inputted joystick displacement amount for the first actuator into a secondary joystick displacement amount having a value reduced at the limiting ratio;

a second joystick converter configured to convert the inputted joystick displacement amount for the second actuator into a secondary joystick displacement amount having a value that is decreased at a ratio in proportion to the secondary joystick displacement amount of the first actuator; and an output portion configured to output the control signals to the first and second spool displacement adjusting valves for controlling the pilot signal pressures in proportion to the secondary joystick displacement amounts of the first and second actuators to limit spool displacement amounts of the first and second control valves wherein the second hydraulic pump is configured to be driven by an engine which drives the first hydraulic pump and supply a working oil to the second actuator, the pump control portion is configured to control discharge pressures of the first and second hydraulic pumps according to a horsepower distribution ratio, and a range of the limiting ratio is determined based on the horsepower distribution ratio.

2. The control system for construction machinery of claim 1, wherein the first and second spool displacement adjusting valves include electro proportional pressure reducing valves (EPPRV).

3. The control system for construction machinery of claim 1, wherein the pump control portion controls the discharge pressures of the first and second hydraulic pumps according to the horsepower distribution ratio that is selected by the operator through the user selection portion.

4. The control system for construction machinery of claim 1, wherein the first actuator includes a swing motor and the second actuator includes a boom cylinder, and the first control valve includes a swing control valve and the second control valve includes a boom control valve.

5. A control method for construction machinery, comprising:

providing a hydraulic system including first and second actuators connected to a first hydraulic pump through first and second parallel lines respectively and first and second control valves installed in the first and second parallel lines respectively and configured to control operations of the first and second actuators according to pilot signal pressures;

receiving a working condition selected by an operator and determining a limiting ratio based on the working condition;

receiving an inputted joystick displacement amount for the first actuator and an inputted joystick displacement amount for the second actuator;

converting the inputted joystick displacement amount for the first actuator into a secondary joystick displacement amount having a value reduced at the limiting ratio;

converting the inputted joystick displacement amount for the second actuator into a secondary joystick displacement amount having a value that is decreased at a ratio in proportion to the secondary joystick displacement amount for the first actuator; and outputting control signals for controlling the pilot signal pressures in proportion to the secondary joystick displacement amounts for the first and second actuators to limit spool displacement amounts of the first and second control valves wherein the control method further comprises providing a second hydraulic pump driven by an engine which drives the first hydraulic pump and configured to supply a working oil to the second actuator; and controlling discharge pressures of the first and second hydraulic pumps according to a horsepower distribution ratio, and wherein a range of the limiting ratio is determined based on the horsepower distribution ratio.

6. The control method for construction machinery of claim 5, wherein the hydraulic system further includes first and second spool displacement adjusting valves which include electro proportional pressure reducing valves (EPPRV).

7. The control method for construction machinery of claim 5, wherein controlling discharge pressures of the first and second hydraulic pumps comprises controlling a horsepower ratio of the first and second hydraulic pumps according to the horsepower distribution ratio selected by the operator.

8. A control system for construction machinery, comprising:

a first hydraulic pump;

first and second actuators connected to the first hydraulic pump through first and second parallel lines respectively and operable by a working oil discharged from the first hydraulic pump;

a second hydraulic pump driven by an engine which drives the first hydraulic pump and configured to supply a working oil to the second actuator;

first and second control valves installed in the first and second parallel lines respectively and configured to control operations of the first and second actuators;

first and second spool displacement adjusting valves configured to supply pilot signal pressures to spools of the first and second control valves in proportion to inputted control signals to control displacement amounts of the spools of the first and second control valves;

a user selection portion configured to when manipulation signals of an operator for a multiple operation of the first and second actuators are received, receive an information about a limiting ratio for the manipulation signal for the first actuator, which is selected by the operator, and receive a horsepower distribution ratio selected by the operator;

a control valve control portion configured to output the control signals to the first and second spool displacement adjusting valves corresponding to the manipulation signals of the operator for the first and second actuators, and configured to decrease the manipulation signal for the first actuator at the limiting ratio and output the control signal corresponding to the decreased manipulation signal for the first actuator to the first spool displacement adjusting valve, and decrease the manipulation signal for the second actuator at a ratio in proportion to the decreased manipulation signal for the first actuator and output the control signal corresponding to the decreased manipulation signal for the second actuator to the second spool displacement adjusting valve to thereby limit a spool displacement amount of the second control valve according to the decreased manipulation signal for the first actuator when the manipulation signals for the multiple operation of the first and second actuators are received; and a pump control portion configured to control discharge pressures of the first and second hydraulic pumps according to the horsepower distribution ratio, wherein a range of the limiting ratio of the manipulation signal selected by the operator is determined based on the horsepower distribution ratio.

* * * * *